US006971523B2

(12) United States Patent
Van Heugten

(10) Patent No.: US 6,971,523 B2
(45) Date of Patent: Dec. 6, 2005

(54) DELICATE GOODS HOLDER, ITS MANUFACTURING AND USE

(76) Inventor: Alphons Maria Van Heugten, Waterlooweg 30, Leusden (NL) NL-3832 RX ( * ) Notice: Subject to any disclaimer, the term of this patent is extended or adjusted under 35 U.S.C. 154(b) by 0 days.

(21) Appl. No.: 10/220,314

(22) PCT Filed: Feb. 23, 2001

(86) PCT No.: PCT/NL01/00152

§ 371 (c)(1),
(2), (4) Date: Aug. 29, 2002

(87) PCT Pub. No.: WO01/64546

PCT Pub. Date: Sep. 7, 2001

(65) Prior Publication Data

US 2003/0047481 A1 Mar. 13, 2003

(30) Foreign Application Priority Data

Feb. 29, 2000 (DE) ..... 100 09 303
Aug. 9, 2000 (NL) ..... 1015900

(51) Int. Cl.[7] ..... B65D 85/34

(52) U.S. Cl. ..... 206/561; 206/521; 206/521.2; 206/521.8

(58) Field of Search ..... D7/503, 611; D9/415, D9/452, 454, 500; 206/521.1, 521.2, 521.8, 206/521.9, 561, 564; 211/14; 217/26.5; 220/4.26, 220/23.2, 507; 248/346.03

(56) References Cited

U.S. PATENT DOCUMENTS 28,238 A * 5/1860 Ladd ..... 211/14
1,759,398 A * 5/1930 Hart ..... 211/14
2,054,934 A * 9/1936 Graffenberger ..... 229/400
2,811,246 A 10/1957 Sloane
D211,513 S * 6/1968 Brown et al. ..... D9/456
3,853,221 A * 12/1974 Boyd ..... 206/523
3,899,161 A * 8/1975 McGann, Jr. ..... 269/13
4,127,758 A * 11/1978 Lowthorp ..... 200/513
4,552,717 A 11/1985 Murley et al.
4,573,586 A * 3/1986 Helmer ..... 211/14
5,165,947 A * 11/1992 Colucci et al. ..... 426/124
6,443,307 B1 * 9/2002 Burridge ..... 206/532

FOREIGN PATENT DOCUMENTS

| | | |
|---|---|---|
| DE | 11 34 019 | 7/1962 |
| FR | 1 144 330 | 10/1957 |
| NL | 103 927 | 9/1962 |
| NL | 278825 | 11/1964 |

OTHER PUBLICATIONS

Patent Abstract Of Japan vol. 1999, No. 09, Jul. 30, 1999 & JP 11 116718 A (Nishi Nippon Noba Form KK; Nagano Noba Form KK) Apr. 27, 1999.

* cited by examiner

*Primary Examiner*—Jim Foster
(74) *Attorney, Agent, or Firm*—Young & Thompson

(57) ABSTRACT

Packaging elements are formed by holders suitable for transport and storage of delicate goods such as fruit, sweets such as chocolate, flowers, glass objects, Christmas decorations, electronic components and the like. The holders are separated from each other by a standing wall. Recommended for larger objects such as apples and the like are holders with the upper part in folded-back form, particularly those wherein the rib profiling of the upper and lower parts take an integral form and thereby enclose firmly the object for transporting (FIG. 4*b*). Smaller objects can advantageously be transported on a mattress of upper parts of smaller holders (FIG. 5*b*).

8 Claims, 2 Drawing Sheets

DELICATE GOODS HOLDER, ITS MANUFACTURING AND USE

BACKGROUND OF THE INVENTION

The invention relates to packaging means which are formed by holders suitable for transport and storage of delicate goods such as fruit, sweets such as chocolate, flowers, glass objects, Christmas decorations, electronic components and the like, wherein the holders are separated from each other by a standing wall.

Owing to the increase in world trade, the time involved in transport and storage of goods for transport is increasing considerably. For the packaging industry it is therefore becoming increasingly important to produce means with which delicate and perishable goods can be transported and stored during standstill in the most shockproof and pressure-proof manner possible.

Packaging means for larger fruits such as tomatoes, apples, peaches and the like with separate holders are known. Transported in this manner, for instance the peaches do not damage each other by mutual contact, although damage does occur through contact with the bottom part of the holder, particularly in the case of ripe fruit. There is farther also a need for improved packaging means for small fruit such as strawberries, cherries and the like, for which separate packaging is not economically viable.

A packaging means according to the present invention generally consists of a plurality of holders. Such a holder consists of a bottom surface which encloses a standing cover layer originating therefrom and situated around a round opening in the bottom surface, which cover layer consists of two parts, i.e. a wall-shaped lower part and a domed upper part, wherein the upper part is preferably thinner than the lower part. According to one aspect of the invention this holder can advantageously be used in folded-back form, wherein a folding edge results. The folded-back domed upper part preferably does not contact the surface on which the bottom surface rests. When a fruit is placed in such a holder, it is situated in a so-called hammock without pressure being exerted anywhere on the fruit.

SUMMARY OF THE INVENTION

The holder generally consists of thermoformed plastic, particularly one of the following plastics, polystyrene, polyethylene, polypropylene or polyvinyl chloride, wherein the thickness of the starting material is about 0.1–1 mm and the thickness of the plastic of the lower part and of the domed upper part of the holder is about 0.002–0.5 mm after forming by heating and deformation. The upper part is herein generally at least twice, preferably at least ten times and more preferably at least twenty times thinner than the lower part. The upper part preferably further has a smaller diameter than the lower part, preferably a minimum of 1 mm smaller. These characteristics give the holder strength and resilience and simplify folding back of the upper part.

The lower and upper part of the cover layer are preferably profiled, for instance ribbed, in the same manner, wherein the ribs of the lower part preferably run over into the upper part. The holder profiled in this manner is exceptionally flexible and has an advantageous harmonica-effect wherein the holder can expand at the position of the folding edge and more products can be transported per surface area of packaging means than if the holder were not to yield, or hardly so, to the shape of the product for storing. Such a harmonica-effect also provides a better enclosure of the product, whereby it is packaged more firmly. The lower part preferably stands slightly conically on the bottom surface, so that the above stated harmonica-effect is utilized as well as possible. Holders with any other profiling, whether or not this be the same for the different parts of the cover layer, otherwise also form part of the subject of the invention.

The upper part of the above described holder can consist of a plurality of parts which are increasingly thinner as seen from the lower part. In some constructions, wherein the transitions between the different parts do not have to run parallel to the separation of the lower and upper parts of the holder, it is possible, depending on the shape of the product for transport or storage, to make even better use of the hammock principle. The oval shape of an egg can for instance be envisaged here.

BRIEF DESCRIPTION OF THE DRAWINGS

The present invention is further elucidated with reference to the following schematic drawings.

Figure 1A:
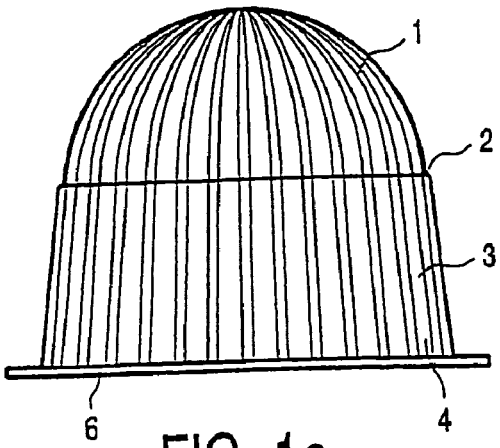
FIG. 1*a* shows a front view of one holder consisting of a bottom surface (6) and a cover layer with a lower part (3) and a domed upper part (1).
Figure 1B:
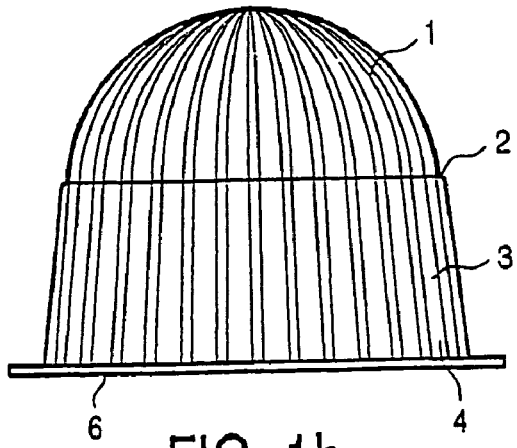
FIG. 1*b* is a front view of one holder consisting of a bottom surface (6) and a cover layer with a lower part (3) and a domed upper part (1), wherein the ribs (4) of the lower part continue into the upper part.
Figure 2:
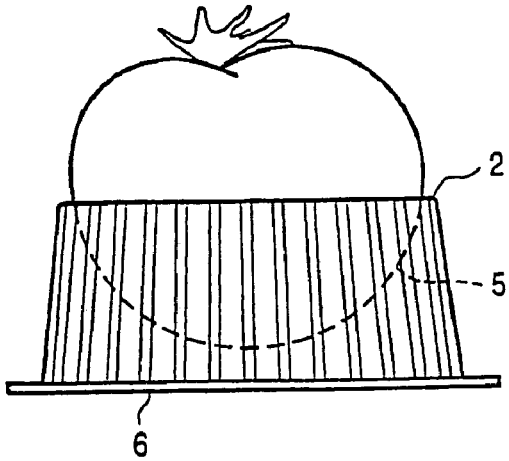
FIG. 2 is a front view of a holder with the domed upper part in folded back form (5) at the folding edge (2) having therein an object for transport or storage such as a fruit.
Figure 3:
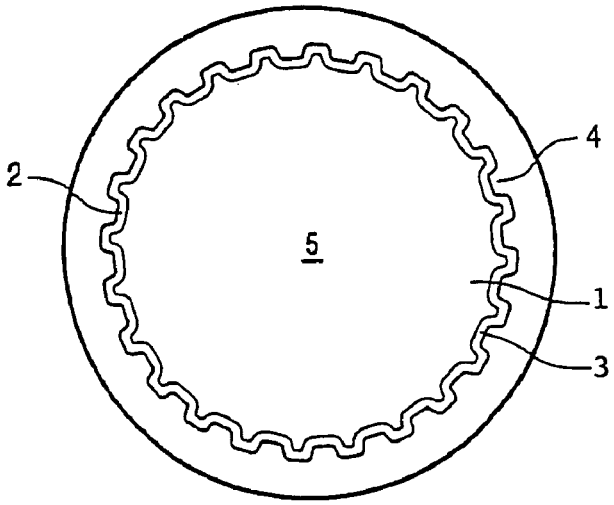
FIG. 3 shows a top view of one holder wherein the ribs (4) of the lower part continue into the upper part.
Figure 4A:
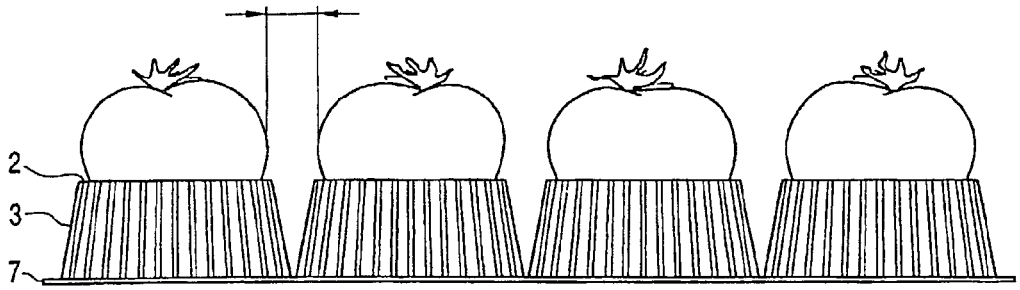
Figure 4B:
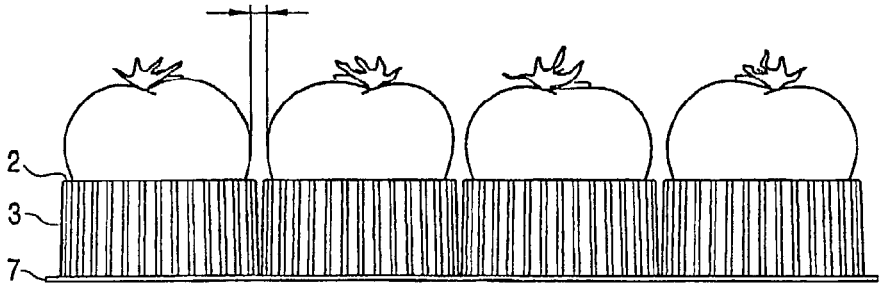

A plurality of holders as described above together generally form a packaging device wherein the bottom surfaces form the base. Examples hereof are shown schematically in FIGS. 4 and 5:

FIGS. 4*a* and 4*b* show a front view of a packaging device consisting of a plurality of holders mutually connected by their bottom surfaces to form a base (7).

Figure 5A:
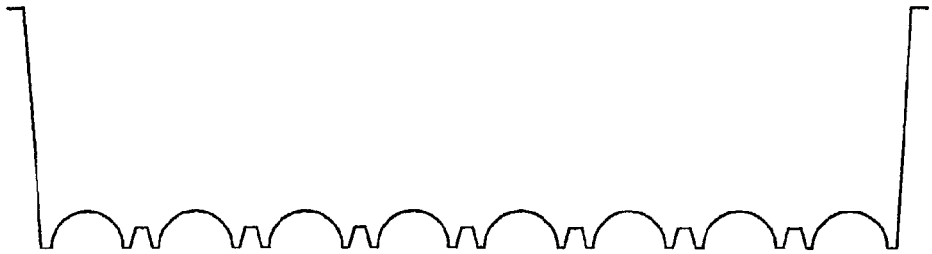
Figure 5B:
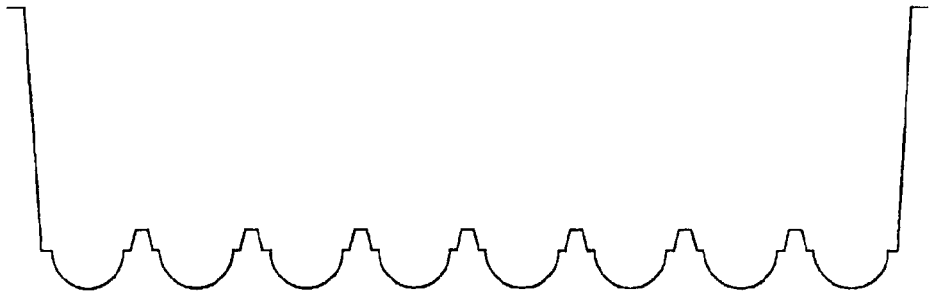

FIGS. 5*a* and 5*b* show a cross-section of a packaging device consisting of a plurality of holders mutually connected by their bottom surfaces with the upper part in folded-back form lower than the bottom surface (FIG. 5*a*) and wherein the objects for storage can be stored on top of the mattress (FIG. 5*b*) formed by turning over (and adjusting of the standing side).

DESCRIPTION OF THE PREFERRED EMBODIMENTS

According to one preferred embodiment of the invention the upper part of the holders in the packaging device is higher than the bottom surface when folded back, i.e. the surface on which the holder rests is not reached by the object resting in the folded-back upper part; the objects for transport and/or storage each rest in a separate holder in the folded-back upper part. This embodiment, shown in FIGS. 4*a* and 4*b*, is particularly suitable for relatively larger objects, and in particular for larger items of fruit, such as tomatoes, pears, apples, oranges, peaches, nectarines, plums, apricots and the like, but also for other vulnerable foods such as eggs and chocolates and glass objects such as Christmas decorations and the like. It will become apparent from a comparison of the two figures that in the packaging device wherein the profiling is such that the ribs of both parts run over into each other as shown in FIG. 4*b*, the angle of the holder to the bottom surface can be almost 90° since a strong harmonica-effect of the holder occurs. An economic advantage is thus obtained in this embodiment since per unit of surface area more or larger pieces of fruit can be transported, which are furthermore enclosed more firmly by the 'hammock'.

According to another preferred embodiment the upper part of the holders which form the packaging device is on the contrary lower than the bottom surface when folded back. (see FIG. 5*a*). The packaging device is preferably applied in this embodiment as follows: the upper part of the holder is folded back, but instead of being placed in the folded back upper part the products for transport and storage are placed on top of the upper part (see FIG. 5*b*). The upper side of these upper parts form as it were a soft 'mattress', certainly when a relatively large number of small holders is present. Packaging devices in this embodiment are suitable for transporting or storing relatively small vulnerable objects, such as small fruit such as strawberries, cherries, grapes, and also other vulnerable objects, such as flowers and the like, for which separate packaging is not viable. This embodiment is also suitable for heavier shapes such as for instance chocolate letters which, by arranging their shape in the so-called mattress, are enclosed by the rest of the mattress and are thereby firmly packaged. It is also possible to apply the upper part in folded-out form, wherein the base of FIG. 5*a* is applied on the other side (and with adjustment of or without standing side).

The above described holders can be produced from a sheet of thermoplastic plastic. It is known to the skilled person how to heat a part of a sheet of thermoplastic plastic within a form the size of the standing cover layer in a dome-shaped mould of the desired form and to press it in plasticized state against the mould from which the product is removed after cooling. In order to produce a holder in the preferred embodiment which consists of two or more parts which is profiled with continuous ribs, the mould is of course cast in this desired form. The preferred embodiment can then still be adjusted when cold, such as for instance folding back of the domed upper parts of the holder.

In order to produce a packaging device which consists of a plurality of holders, a plurality of parts is pressed in the same number of moulds from a sheet of thermoplastic plastic and further processed in the manner indicated above.

It will be apparent to the skilled person that the inventive concept enables a wide application and is certainly not limited to the given examples, which are only used by way of illustration.

What is claimed is:

1. A holder for transporting and storing a delicate product, comprising:

a bottom sheet with at least one structure for forming a hollow pocket, said structure having a lower part having an upper extremity, a rounded dome-shaped upper part with a lower extremity, and a transition between said extremities, said lower extremity of said dome-shaped upper part having a perimeter that is smaller than the perimeter of the extremity of said lower part, wherein the structure is adapted to be folded at said transition so that said dome-shaped upper part is inverted so as to from said pocket.

2. The holder of claim 1, wherein said upper part and said lower part each have an undulating profile.

3. The holder of claim 2, wherein said sheet comprises plural ones of said structure that are directly adjacent to each other, and wherein the undulating profile of one said structure interleaves with the undulating profile of an adjacent said structure.

4. The holder of claim 1, wherein said upper part is thinner than said lower part.

5. The holder of claim 1, wherein said sheet is thermoformed plastic.

6. The holder of claim 1, wherein said lower part is frusto-conical.

7. The holder of claim 1, wherein said upper part is above a plane of said sheet when said upper part is folded into said lower part.

8. The holder of claim 1, wherein said upper part is below a plane of said sheet when said upper part is folded into said lower part.

* * * * *